US005265859A

United States Patent [19]

Watson et al.

[11] Patent Number: 5,265,859

[45] Date of Patent: Nov. 30, 1993

[54] SHEET FEED APPARATUS

[75] Inventors: Peter R. Watson, Stevenage Herts, United Kingdom; Nicholas Frank, London, England; Paul Swallow, Stevenage Herts, United Kingdom

[73] Assignee: Xerox Corporation, Stamford, Conn.

[21] Appl. No.: 940,554

[22] Filed: Sep. 4, 1992

[30] Foreign Application Priority Data

Sep. 11, 1991 [GB] United Kingdom ..... 9119481

[51] Int. Cl.[5] ..... B65H 3/06

[52] U.S. Cl. ..... 271/109; 271/117; 271/124

[58] Field of Search ..... 271/109, 117, 121, 124, 271/125

[56] References Cited

U.S. PATENT DOCUMENTS

| | | | |
|---|---|---|---|
| 4,475,731 | 10/1984 | Wood | 271/109 |
| 4,565,360 | 1/1986 | Rünzi | 271/4 |
| 5,040,779 | 8/1991 | Ogiri et al. | 271/109 |
| 5,156,388 | 10/1992 | Morita | 271/109 |

FOREIGN PATENT DOCUMENTS

| | | | |
|---|---|---|---|
| 125538 | 7/1983 | Japan | 271/109 |
| 86330 | 5/1986 | Japan | 271/109 |
| 294131 | 11/1989 | Japan | 271/109 |
| 0260008 | 3/1988 | United Kingdom . | |
| 0339977 | 11/1989 | United Kingdom . | |

*Primary Examiner*—David H. Bollinger
*Attorney, Agent, or Firm*—Kevin R. Kepner

[57] ABSTRACT

The invention relates to a sheet feed apparatus which is particularly, although not exclusively, useful in a xerographic copying machine. The apparatus includes a roller assembly including first and second rollers, the first roller being arranged to engage the top sheet in a stack of sheets and advance the sheet to a nip defined between the second roller and a retard member. The roller assembly is attachable to a support such as a feed-head cover, by means of a snap-in connection whereby, when assembled to the support way, the second roller is operably coupled to a drive gear. In order to facilitate connections between a drive shaft through the second roller and the drive gear, the drive shaft is biassed towards the drive means by a compression spring, and is mounted for movement along the axis of the second roller against the bias of the compression spring.

10 Claims, 3 Drawing Sheets

SHEET FEED APPARATUS

The present invention relates generally to a sheet feeder and more particularly to the mounting arrangement for the roller used in the sheet feeder.

Where sheets are arranged in a stack it is conventional to feed them one at a time from the stack using a roller feed arrangement located in the feedhead of the apparatus. The sheets are stacked on a stack support, for example a tray, movable between a sheet feeding position in which the sheets can be fed from the tray and a retracted, sheet loading, position in which sheets can be loaded or unloaded from the tray. It is difficult to feed the sheets one at a time since there is a tendency for sheets to feed together due to frictional and binding forces between them. In order to alleviate this problem it is well-known to utilize an arrangement of the kind known as a retard feeder in which the sheets are advanced into the nip between a driven sheet advancing member, suitably a roller, and a stationary friction or retard member, which coact such that a first sheet in contact with the sheet advancing member may be advanced through the nip by driving the advancing member, other sheets also in the nip area being retarded by the stationary retard member.

A known sheet retard feeder is shown schematically in FIG. 1 illustrating a roller assembly comprising a nudger roller 6 and a feed roller 4 mounted for rotation on respective shafts 10, 8. One end of the shaft 8 of feed roller 4 is coupled to a drive shaft located at the feeder, the other end of the shaft 8 being mounted in a bearing. A gear (not shown) is provided on the shaft 8 for enmeshment with a gear 26 forming part of a gear train operably coupling the nudger roller 6, via a gear (not shown) on the shaft 6, to the feed roller 4. Rotation of the feed roller 4 causes rotation of the nudger roller 2, the speed of rotation of the nudger roller 6 being dependent on the gear ratio of the gear train. Below the feed roller is a retard pad 13 which together define a nip through which the sheets S are fed.

In operation sheets S are fed from a stack 15 which is brought, by positioning the paper tray, into the feeding position. The top sheet in the stack 15 is engaged by the nudger roller 6, which on rotation feeds the top sheet towards the nip formed between the feed roller 4 and the retard pad 13. Frictional forces and static electricity between the sheets of paper in the stack 15 may cause several sheets S to move into the nip together. If several sheets of paper approach the nip together, the friction between the retard pad 13 and the bottom sheet of those being fed is greater than that between two sheets. The friction between the feed roller 4 and the top sheet S1 is also greater than the friction between two sheets. The group of sheets being fed towards the nip will therefore tend to become staggered on the surface of the retard pad 13 up into the nip, until the lower sheet S2 of the top two sheets is retained by the retard pad 13, while the topmost sheet S1 is fed by the feed roller 4.

The roller assembly of FIG. 1, in prior art arrangements, is secured into the feedhead and accurately aligned therein by means of a mounting plate and screw fitting, their replacement and installation being carried out by a machine maintenance engineer. In the case of high capacity feeders the roller assembly may require to be changed between fifteen to twenty times during the life of the machine. In each case removal of the roller assembly involves unscrewing of the attachments and removal of the mounting plate from the feedhead. During the installation of the replacement roller assembly, care must be taken to ensure its accurate alignment in the feedhead. These operations require the services of a trained maintenance engineer which is both time consuming and costly.

In accordance with one aspect of the present invention, there is provided a sheet feeding apparatus. The apparatus comprises means for supporting a stack of sheets and a roller assembly. Means for detachably mounting said roller assembly on said supporting means adjacent the stack of sheets to enable said roller assembly to advance sheets from the stack thereof, said mounting means providing a snap-fit connection facilitating attachment and removal of said roller assembly to and from said supporting means is also provided.

The invention will be described further, by way of example, with reference to the accompanying drawings, in which.

Figure 1:
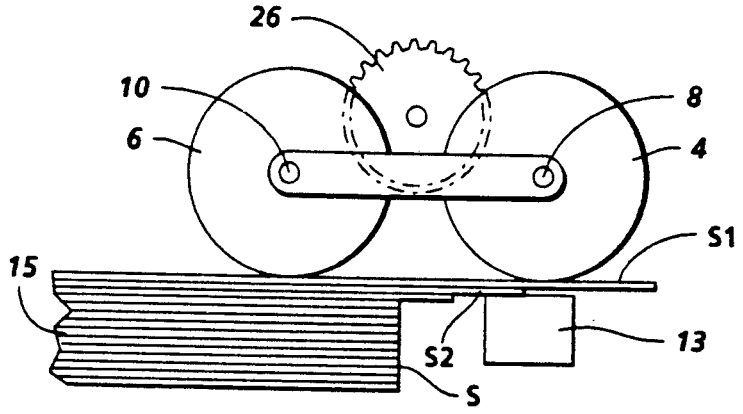
FIG. 1 PRIOR ART
FIG. 1 is a schematic elevational view showing a prior art roller assembly used in a sheet feed apparatus.

The invention will now be described with reference to one embodiment of roller assembly shown in FIGS. 2 to 5, the same reference signs being used in FIGS. 2 to 5 to indicate the same features. It is to be noted that in this embodiment the roller assembly would in practice be used to deliver sheets one at a time using the nip between a drive roller (referred to by numeral 4 in FIG. 2) and a retard member like that illustrated in FIG. 1 and referred to by numeral 13 therein.

Figure 2:
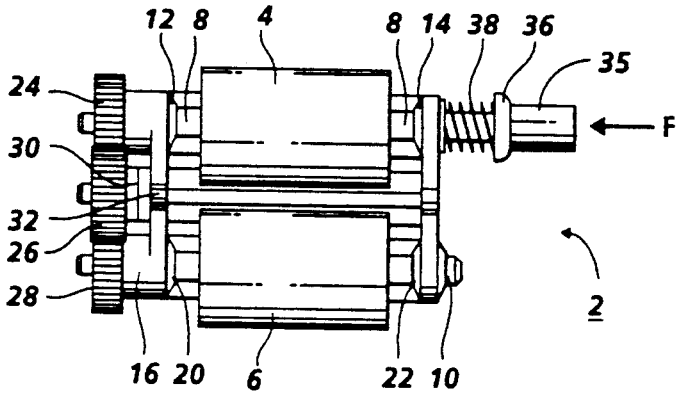
FIG. 2 is a plan view of a roller assembly according to an embodiment of the present invention.
Figure 3:
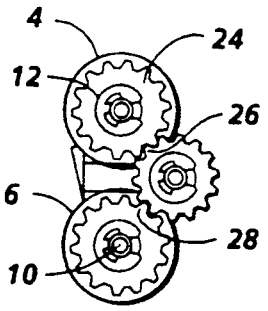
FIG. 3 is one side elevational view of the FIG. 2 roller assembly.
Figure 4:
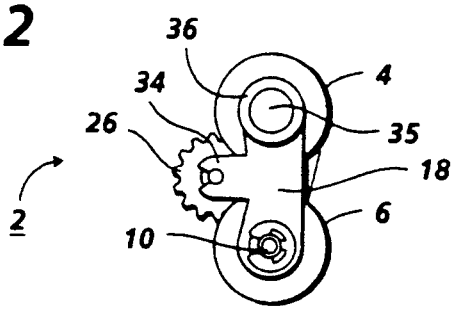
FIG. 4 is the other side elevational view of the FIG. 2 roller assembly.
Figure 5:
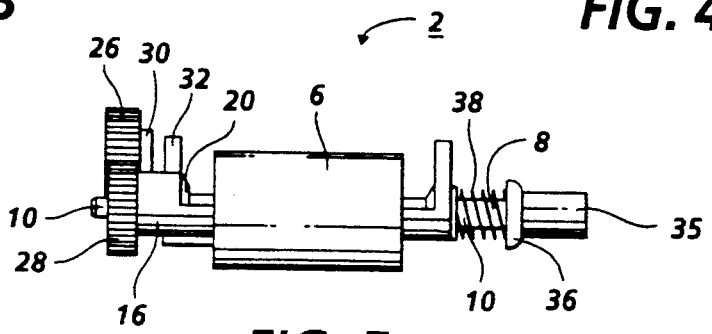
FIG. 5 is a front elevational view of the FIG. 2 roller assembly.

Referring to FIG. 2, a roller assembly 2 is formed as a single unit comprising a feed roller 4 and a nudger roller 6 each mounted on a drive shaft 8 and nudger shaft 10 respectively. The drive shaft 8 is supported for rotation in a pair of bearings 12, 14 formed in a pair of spaced, plastic, side brackets 16, 18 of the roller assembly 2. The side brackets 16, 18 are connected together by an integral plastic section 33. Likewise the nudger shaft 10 is supported for rotation in a pair of bearings 20, 22 also formed in the side brackets 16, 18. The side brackets 16, 18 and the connecting section 33 are molded to form an integral plastic framework for holding the rollers 4, 6 on their stainless steel shafts 8, 10.

One end of the drive shaft 8 is provided with a plastic gear wheel 24 which together with plastic gear wheels 26, 28 forms a gear train by means of which rotation of the drive shaft 8 causes rotation of the nudger shaft 10. As can be seen more clearly in FIG. 3 the gear wheel 28 is mounted on the end of the nudger shaft 10 and meshes with the intermediate gear wheel 26 which itself meshes with the gear wheel 24. The intermediate gear wheel 26 is mounted for rotation on a bearing 30 which is formed in the side bracket 16. Each of the side brackets 16, 18 is provided with an integral, u-shaped, upstanding lug 32, 34 respectively. The lugs 32, 34 are formed in a central region of the side brackets 16, 18 and are shaped to be snapped into place over respective plastic support projections on a suitable support, described later with reference to FIG. 6, thereby providing a snap-in connection for the roller assembly.

Unlike the nudger shaft 10, the drive shaft 8 is mounted to permit limited reciprocal movement along its axis. The end of the drive shaft 8 remote from the gear wheel 24 is provided with a plastic cover 35 defining an annular shoulder 36, the space around the protruding section of the drive shaft 8 between the shoulder 36 and the opposite facing wall of the side bracket 14 accommodating a compression spring 38. In the normal operating state of the roller assembly 2 as shown in FIG. 2 the compression spring biases the drive shaft 8 to the right ensuring engagement between the gear wheel 24 and the intermediate gear wheel 26. If desired, however, a force can be applied to the end of the drive shaft 8 in the direction of arrow F causing compression of the compression spring 36, moving the drive shaft 8 to the left thereby causing disengagement of the gear wheel 24 from the intermediate gear wheel 26. This facility is utilized when assembling the roller assembly 2 into the feedhead as will be described hereinafter.

As referred to above the roller assembly 2 is formed as a separate substantially plastic unit. This unit is fitted and supported in a support member associated with the sheet feed apparatus. The support member may take many different forms dependent on the particular application and machine but will be described hereinafter, by way of example as being a molded plastic feedhead cover 40 for use in a high capacity sheet feeder of a printer or copier. Such a feedhead cover 40 is illustrated in FIG. 6 which represents an elongate length of the cover 40, the cover 40 being molded to receive and accommodate the roller assembly 2 as a snap-in single component which can readily be replaced when necessary.

The feedhead 40 has wall formations which in its central underside region define two chambers 42, 44 for receiving the rollers 4, 6. The chamber 42 is defined between a curved side of a longitudinal wall 46, a small opposed wall 50 and two opposed end walls 52, 54. The wall 46 is shown in section in FIG. 7 which shows a section along line 7B—7B in FIG. 6. The chamber 44 is likewise defined between a curved side of the wall 46, a wall 48 and two opposed end walls 56, 58. Each of the end walls 52, 54, 56 and 58 is provided with a curved recess 60 for accommodating the shafts 8, 10 of the roller assembly. Two small projections 62, 64 extend longitudinally from the ends of the wall 46 for receiving the lugs 32, 34 of the roller assembly.

To assemble the roller assembly unit 2 into the feedhead 40 it is moved in the direction of arrow A shown in FIG. 7 until the lugs 32, 34 of the roller assembly have snapped over the projections 62, 64 and the rollers 4, 6 have been received in the chambers 42, 44. During the assembly operation the end of the drive shaft 8 is urged in the direction of arrow F (FIG. 2) and released when the roller 4 is aligned in the chamber 42 enabling engagement with the end of the main drive shaft positioned along a channel 66 formed within the feedhead 40. The main drive shaft is mounted for rotation in two bearings 70, 72, which are integral parts of the molded feedhead 40, located at opposite ends of the channel 66. The end of the main drive shaft extends into a wider channel section 68 where it engages within a recess formed in the end of the plastic cover 35 on the end of the drive shaft 8 (FIG. 2) thereby forming the operable coupling between the drive shaft 8 and the main drive shaft.

Figure 6:
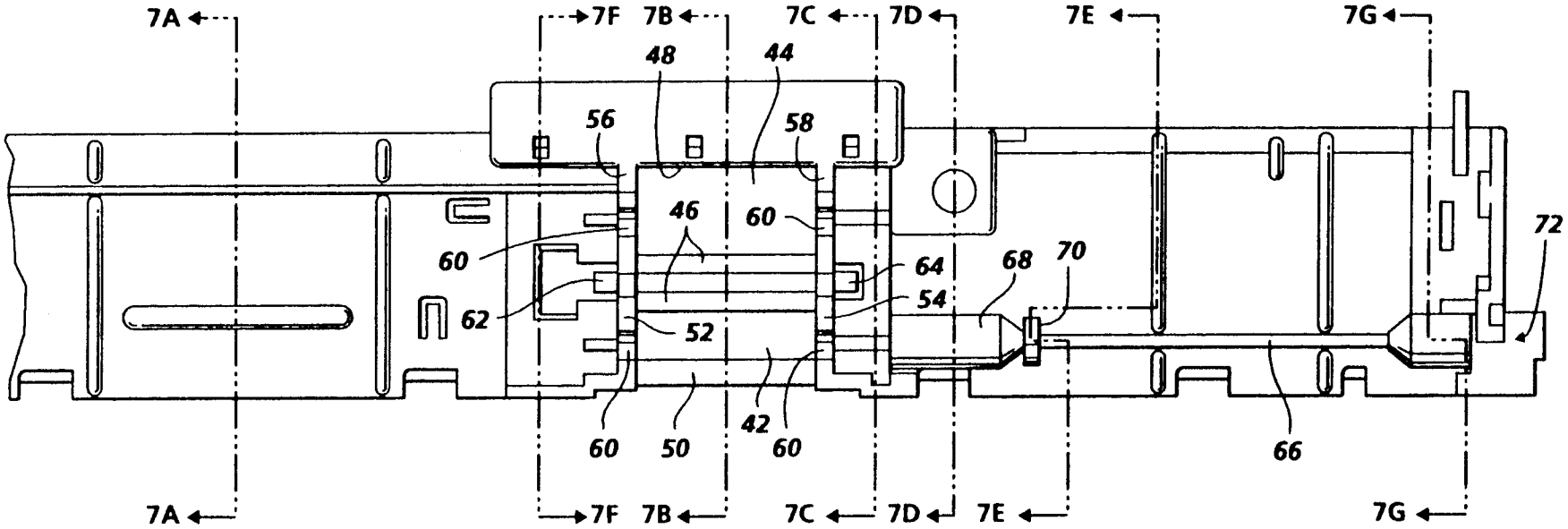
FIG. 6 is a plan view of a feedhead cover for a printer.
Figure 7A:
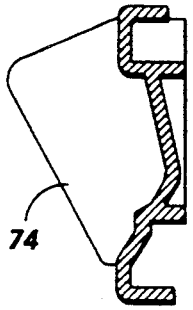
FIG. 7A is a sectional view taken along the line in the direction of arrows 7A—7A of FIG. 6.
Figure 7B:
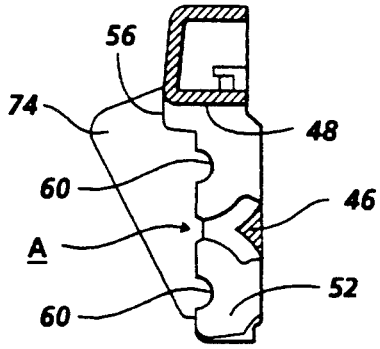
FIG. 7B is a sectional view taken along the line in the direction of arrows 7B—7B of FIG. 6.
Figure 7C:
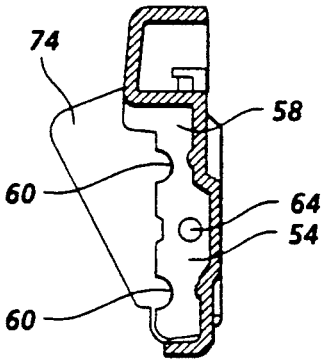
FIG. 7C is a sectional view taken along the line in the direction of arrows 7C—7C of FIG. 6.
Figure 7D:
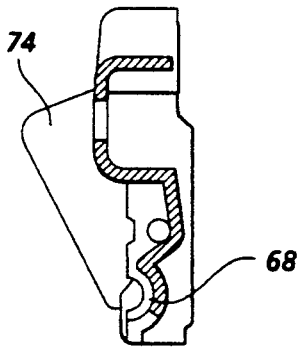
FIG. 7D is a sectional view taken along the line in the direction of arrows 7D—7D of FIG. 6.
Figure 7E:
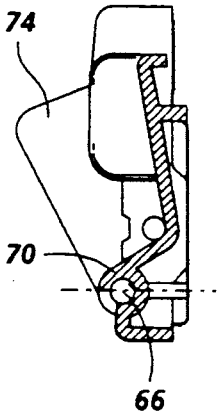
FIG. 7E is a sectional view taken along the line in the direction of arrows 7E—7E of FIG. 6.
Figure 7F:
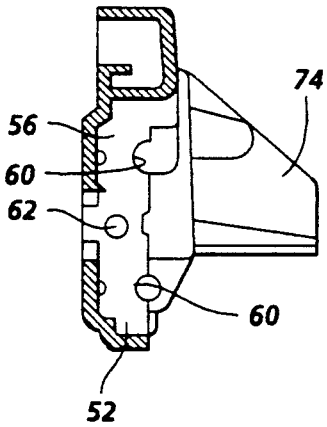
FIG. 7F is a sectional view taken along the line in the direction of arrows 7F—7F of FIG. 6.
Figure 7G:
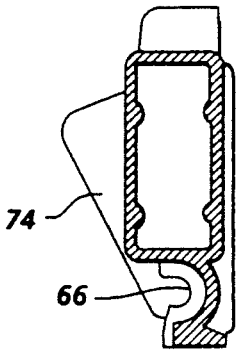
FIG. 7G is a sectional view taken along the line in the direction of arrows 7G—7G of FIG. 6.

The sections through the feedhead 40 are illustrated in FIGS. 7 to 7, the same reference numerals being used to indicated the same features in FIG. 6. Numeral 74 indicates an end support flange of the feedhead 40. Whilst the invention has been described above in relation to a specific embodiment thereof, it will be appreciated that alternative embodiments will be apparent to those skilled in the art. For example, in the described embodiment the lug members 32, 34 are formed on the side brackets 16, 18 of the roller assembly 2 and cooperate with respective projections 62, 64 formed on the wall formations within the feedhead 40. In an alternative embodiment the lug members are formed on the wall formations of feedhead 40 and the projections formed on the side brackets 16, 18 of the roller assembly 2. Also the invention is not limited to the use of lug members and cooperating projections in that other forms of snap connections can be used. It is found preferable, however, to form the snap connections using cooperating members which are integrally formed with the roller assembly and the support means thereby reducing cost of production and facilitating further the ease with which the roller assembly can be replaced.

What is claimed is:

1. A sheet feeding apparatus, comprising:

means for supporting a stack of sheets, said supporting means comprising a retard pad;

a roller assembly comprising a feed roll being adapted to be positioned adjacent said retard pad to define a nip therebetween, and a nudger roll adapted to be positioned adjacent an outermost sheet of the stack to advance successive outermost sheets to the nip defined by said feed roll and said retard pad; and means for detachably mounting said roller assembly on said supporting means adjacent the stack of sheets to enable said roller assembly to advance sheets from the stack thereof, said mounting means providing a snap-fit connection facilitating attachment and removal of said roller assembly to and from said supporting means.

2. The apparatus according to claim 1, further comprising:

means, mounted on said supporting means, for driving said feed roll; and means for disengageably coupling said feed roll with said drive means so as to allow the snap-fit of said roller assembly with the sheet feeder.

3. The apparatus according to claim 2, wherein said roller assembly comprises a drive mechanism adapted to operatively connect said feed roll and said nudger roll to rotate in unison.

4. The apparatus according to claim 3, wherein said mounting means comprises:

a lug member mounted on said roller assembly; and a projection, mounted on said supporting means, adapted to mate with said lug member to provide the snap-fit connection between said roller assembly and said supporting means.

5. The apparatus according to claim 4, wherein said roller assembly comprises:

a first shaft axially supporting said feed roll;

a first side bracket supporting said shaft; and means for biasing said first shaft in a first axial direction connecting a first end of said first shaft and said first side bracket, with said first shaft being movable relative to said feed roll in an axial direction opposed from said first direction.

6. The apparatus according to claim 5, wherein said first shaft comprises a first end adapted for coupling with said drive means, said biasing means urging said first end into engagement with said drive means.

7. The apparatus according to claim 6, wherein said roller assembly comprises a second side bracket opposed to said first side bracket, said first side bracket and said second side bracket supporting said feed roll and said nudger roll.

8. The apparatus according to claim 7, wherein said first side bracket and said second side bracket are formed integrally.

9. The apparatus according to claim 8, wherein said roller assembly comprises a second shaft axially supporting said nudger roll said first side bracket and said second side bracket axially supporting said first shaft and said second shaft substantially parallel to one another.

10. The apparatus according to claim 1, wherein said supporting means comprises a cover, said mounting means connecting said roller assembly and said cover.

* * * * *